US005596934A

United States Patent [19]

Hamm et al.

[11] Patent Number: 5,596,934

[45] Date of Patent: Jan. 28, 1997

[54] SEISMIC RESTRAINT SYSTEM

[75] Inventors: Dennis Hamm; Glenn Brake; James G. Johanson, all of Pasadena, Calif.

[73] Assignee: Pacific Bank Technology, Inc., Pasadena, Calif.

[21] Appl. No.: 381,746

[22] Filed: Feb. 1, 1995

[51] Int. Cl.[6] ..... E05G 1/00

[52] U.S. Cl. ..... 109/50; 109/52; 109/53; 109/56; 248/354.3; 248/500

[58] Field of Search ..... 109/45, 49, 49.5, 109/50, 47, 52, 53, 56, 57, 1 S, 1 R; 52/167.3; 312/245; 248/354.3, 500

[56] References Cited

U.S. PATENT DOCUMENTS

| | | | |
|---|---|---|---|
| 1,256,869 | 2/1918 | Blixt et al. | 109/53 |
| 1,750,291 | 3/1930 | Whetstone | 109/56 X |
| 2,335,779 | 11/1943 | Mazzei | 109/1 R X |
| 2,736,627 | 2/1956 | Horn | 312/245 X |
| 3,334,597 | 8/1967 | Ruskin et al. | 109/1 R X |
| 3,880,394 | 4/1975 | Wisecarver | 248/354.3 |
| 3,948,581 | 4/1976 | Helman et al. | 312/245 X |
| 3,970,010 | 7/1976 | Cantley | 109/56 |
| 3,998,294 | 12/1976 | Moeller | 248/354.3 X |
| 4,073,554 | 2/1978 | Oder et al. | 312/199 |
| 4,341,166 | 7/1982 | Cantley | 109/53 |
| 4,608,932 | 9/1986 | Bohland et al. | 109/56 |
| 4,684,097 | 8/1987 | Cox | 248/354.3 |
| 5,169,219 | 12/1992 | Obbink | 248/354.3 X |
| 5,215,366 | 6/1993 | Givens | 312/245 X |

FOREIGN PATENT DOCUMENTS

| | | | |
|---|---|---|---|
| 0113302 | 7/1984 | European Pat. Off. | 109/50 |
| 3241442 | 5/1984 | Germany | 109/53 |
| 59731 | 1/1924 | Sweden | 109/50 |
| 536540 | 5/1941 | United Kingdom | 109/15 |
| 2030965 | 4/1980 | United Kingdom | 248/500 |

*Primary Examiner*—Lloyd A. Gall
*Attorney, Agent, or Firm*—Wagner & Middlebrook

[57] ABSTRACT

A seismic restraint system for vault located bank safety deposit box modules and the like. This system includes a beam or strongback which extends along the top of a row of safe deposit box modules. A series of adjustable columns bear against the beam and the ceiling of the safe deposit vault. Horizontal bars extend laterally from the beam for securement to an adjacent wall or other vertical support. In one embodiment, a rectangular beam assembly with a plurality of adjustable columns is used to secure a freestanding stack of modules. Resilient pads and stepped beams accommodate differences in heights of modules.

12 Claims, 4 Drawing Sheets

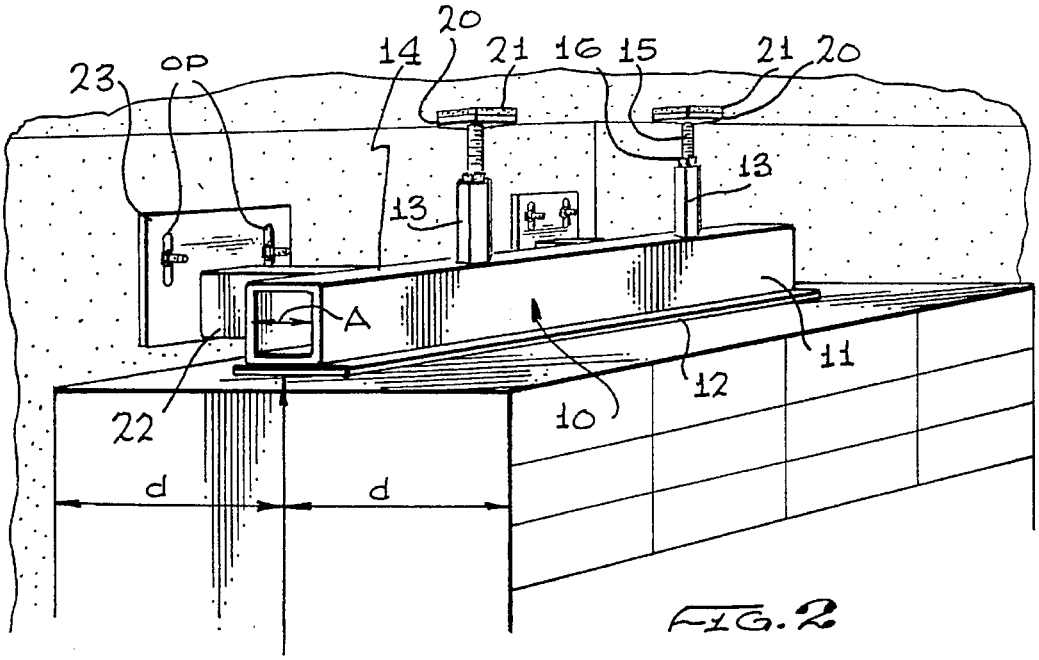
FIG. 2
FIG. 5
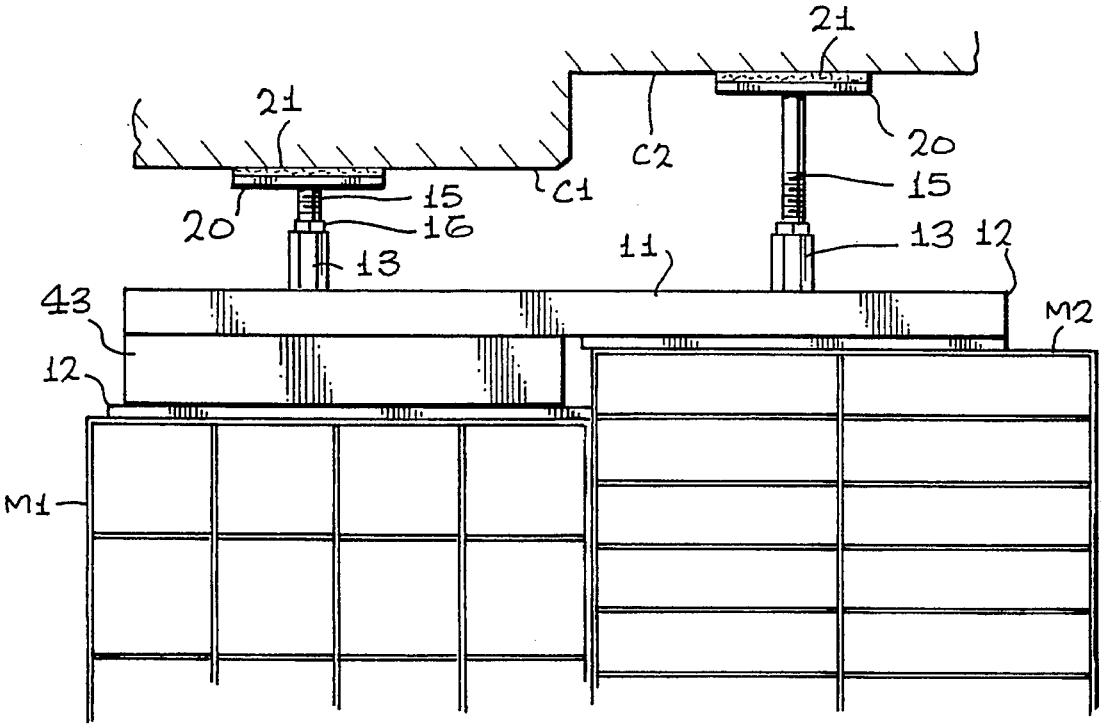

SEISMIC RESTRAINT SYSTEM

BACKGROUND OF THE INVENTION

For well over a century, the public has relied upon the bank safe deposit vault as a reliable receptacle for their valuables of jewelry, negotiable securities and other items. Banks are proud to provide this service in which security is the result of the vault being of reinforced concrete with a secure door, time locks, and various other security measures. Well known to the bank customer is the feature that a box of the appropriate size for their needs is available and access is limited to banking hours where only authorized persons with a proper key can reach the box when trusted bank personnel provide and use a second key to open the box protecting door. The customer may then have access to the box which is removable to a private booth in which the customer may add or remove contents. There is no record of the contents of the box since this is a private matter of the box renter.

The bank, in providing boxes of several sizes, will maintain in the vault modules of different size boxes, for example, a module containing four large boxes each having approximately 3 cubic feet of storage space, to the smallest boxes in a module containing as many as 28 boxes each having a storage space in the order of ⅙ cubic foot, sufficient to hold a number of documents 6 inches by 12 inches in size, common dimensions for securities with space left over for other valuables.

The modules are of various sizes, for example, 24 inches by 24 inches and 12 inches by 24 inches in front, and have a common depth of approximately 26 inches to provide a uniform front surface. The modules, because of their heavy double lock doors in front, interior sturdy box and enclosure for each box behind the door are surprisingly heavy, being in the order of 100 pounds each when empty. Modules are usually stacked to a height of approximately 6' from the floor. The weight of a stack of modules is not a problem since the vault has a reinforced floor capable of holding much more than the weight of many modules even if filled with jewelry or bullion.

The modules are normally stacked to within a few inches of the vault ceiling and placed in rows with 3 to 4 feet spacing between the rows. Normally, safe deposit vaults are accessed by a single customer with a single bank representative at a time, so the corridors need not be large. More stacks of modules may therefore be contained in a vault. In most cases the weight of the modules has been considered to be sufficient to provide a column of boxes which are perfectly safe from movement.

Recently, however, it is recognized that from the structural standpoint, the stacks of modules may move, tip or fall under such conditions as seismic activity. It has likewise been learned that even the dual lock doors may not hold boxes in place in a module if the module falls. The integrity of individual boxes under such conditions is the sole protection against the contents of boxes being commingled. Of even greater importance, if someone is present in the vault at the time of some seismic activity or other action, such as bank personnel rearranging or adding additional modules which could cause a module to fall, there is real danger to the persons present in the vault.

We have also discovered that there appears to be little standardization among different manufacturers of safe deposit boxes in their dimensions except as to depth and box dimensions. Banks have acquired modules from different manufactures and stacked them in intermixed arrangements.

Therefore, the height of various modules may vary. Likewise, vaults may have different floor to ceiling dimensions. These variations in configuration usually result in compromise to the stability of intermixed safe deposit boxes.

BRIEF STATEMENT OF THE INVENTION

Faced with this state of the art, we determined that it is possible to secure bank safe deposit boxes and their modules so that they remain secure despite seismic activity of a level which could otherwise destroy the modules and boxes. This can be done despite significant variations in dimensions of the modules, and the vault walls and ceilings.

We have devised a universal bracing system which is adaptable to nearly all bank vault installations and which may be installed without disturbing or modifying of the vault or the boxes or modules in any respect. When completed, the structural support system may be totally enclosed so as not to be visible. The system may still be easily inspected at any time.

The system involves a horizontal compression beam or main girder member with integral upstanding receiver for threaded shafts. The upstanding receivers are placed at distances apart along the compression beam greater than the width of a single safe deposit box module. For module arrays of up to four or five modules in width, two receivers are located at regular distances and approximately one foot from the end of the compression beam. A ceiling base plate with an elongated captured nut is designed to be compressed against the ceiling of the vault, immediately above each receiver. A continuously threaded rod, for example, 1 inch in diameter, is threaded between the receiver and the ceiling plate. The threaded rod is cut to length either before delivery or on site. The cutting of the threaded rod is the only site modification required.

At the rear side of the compression beam is a rearward extension, located at the same place along the compression beam as the receiver. The rearward extension includes a wall plate with bolt holes for mounting to an adjacent wall. The rearward extension has a length which approximates one half of the standard depth of safe deposit boxes in a module and with the wall plate takes up any space from the rear of the stack of modules to the adjacent wall.

When the ceiling to floor distance above a module array vary, different length threaded rods are used. When different height modules are located side by side, the difference is accommodated by plates or tubes secured to the compression beam and the ceiling base plate on its lower side, as needed. A slightly resilient pad is located on the bottom side of the compression beam to accommodate slight, e.g., 1/16 inch to ¼ inch differences in height of adjacent modules.

Free standing or back to back stacks of modules which are not adjacent to walls are secured by interconnected double compression beam assemblies.

BRIEF DESCRIPTION OF THE DRAWING

This invention may be more clearly understood from the following detailed description and by reference to the drawing, in which:

FIG. 2 is a fragmentary perspective view of an array of modules of safe deposit box modules with our invention in place;

FIG. 5 is a fragmentary front elevational view of an array of safe deposit modules of different height in a vault having ceiling sections of different height;

DETAILED DESCRIPTION OF THE INVENTION

Figure 1:
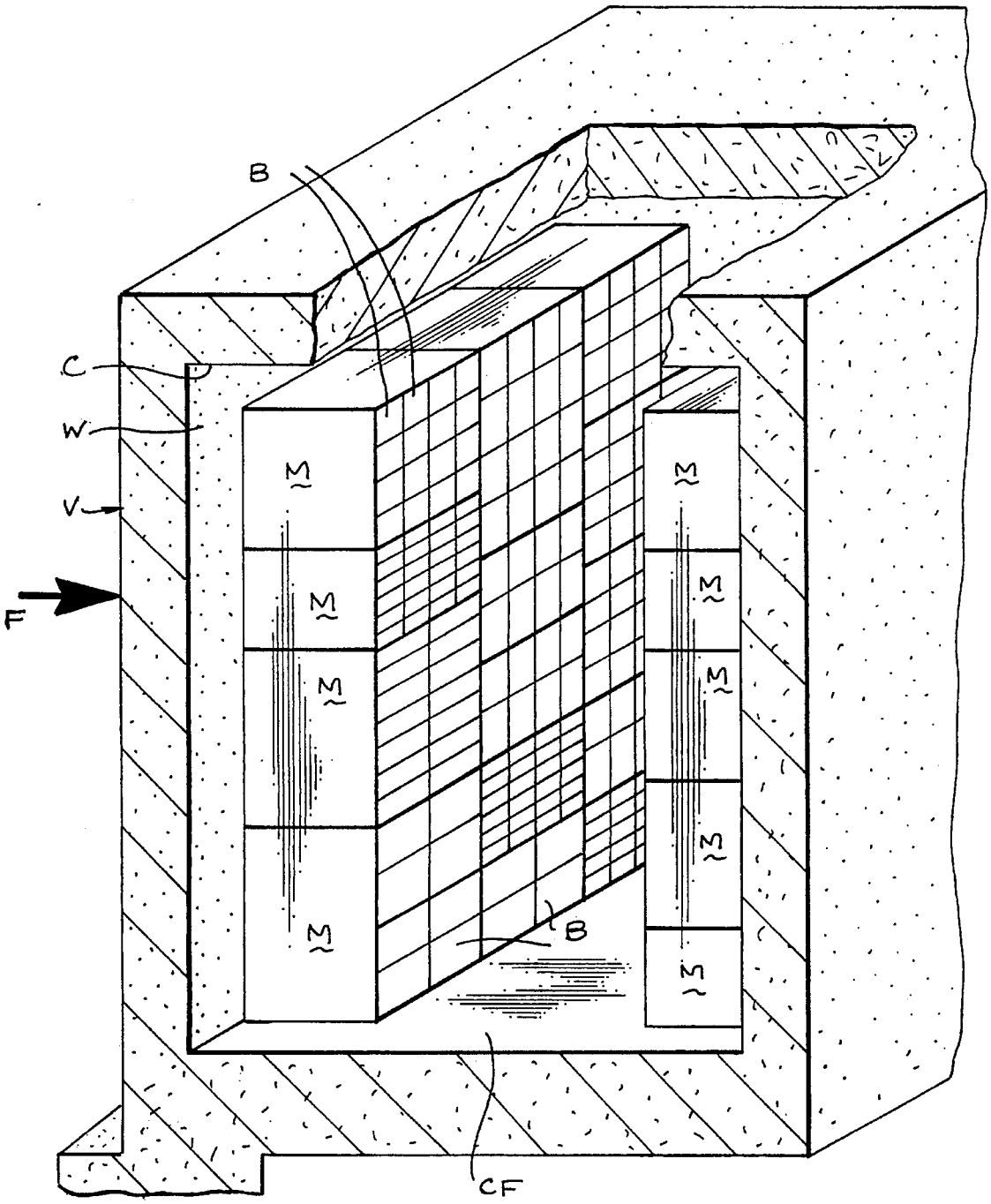
FIG. 1 is a perspective view of a typical safe deposit vault, sectioned just inside of the vault door showing arrays of safe deposit boxes in modules and without our invention.

Now referring to the drawing FIGS. 1–4, a vertical section through a typical small safe deposit vault, generally designated V is shown, just inside of its heavy secure vault door, but showing its reinforced concrete floor CF, walls W and ceiling C. An array of modules M, each having a rectangular array of safe deposit boxes B of which only the front door may be seen. The modules M and the boxes B are all of different sizes to accommodate the needs of different customers. The modules M are stacked on top of each other. They have generally the same depth, of usually 26 inches and generally the same width, e.g., 32 ⅝ inches, with flat bottom and top to stack easily. Although not too apparent in FIG. 1, the modules M, when stacked, often have slightly different overall heights. The modules M are usually just stacked within the vault. Surprisingly, because of their fairly heavy construction, each stack of modules easily weighs in the order of 2000 pounds.

Under normal conditions, the modules M remain in place once that they have been moved into the vault V and never move during their useful life. As the bank customers needs change, the bank may have to add modules or change its mix of box sizes. This is usually done by adding more rows of modules, such as the right hand row in FIG. 1. Often, in larger vaults than is shown in FIG. 1, a free standing stack of modules is present as is described below and illustrated in FIG. 6.

Under lateral forces, as illustrated by the arrow force in FIG. 1, the modules M may tip and fall with the full force of their weight, the weight of the enclosed boxes, and contents. As is illustrated in FIGS. 1–6, the aisles are fairly small and anyone in the aisle during seismic activity might be severely injured by a falling module. Even if the modules were located in an enclosure similar to a file cabinet, their security would not be assured as illustrated by the fact many locked file drawers of filing cabinets which have fallen disgorging their contents in recent earthquakes or nearby explosions. This invention is intended to prevent that occurrence for bank safe deposit boxes.

Figure 3:
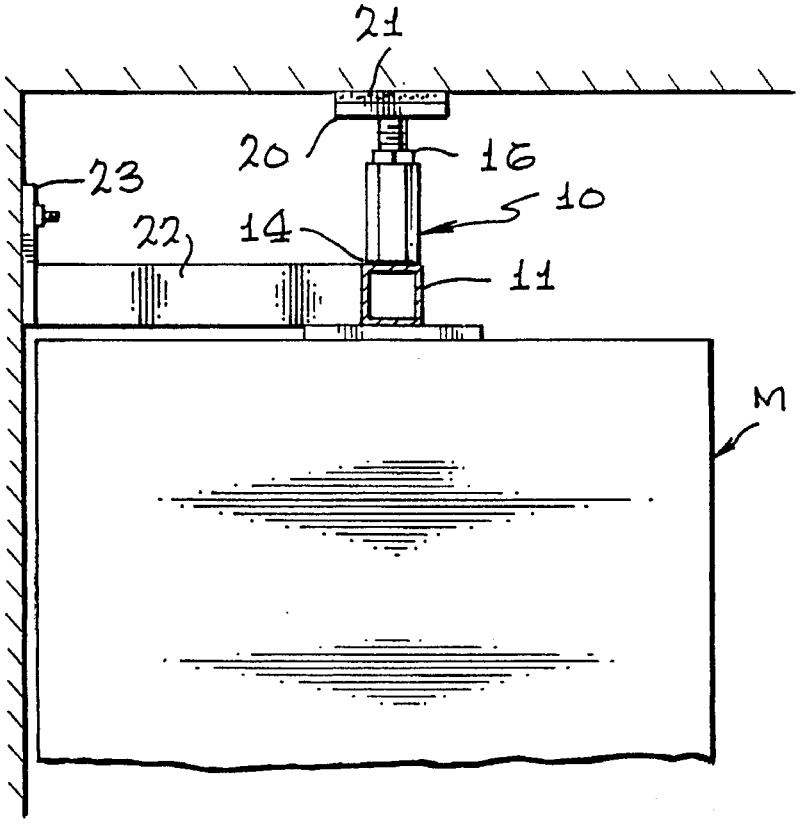
FIG. 3 is a side elevational view of the assembly of FIG. 2.
Figure 4:
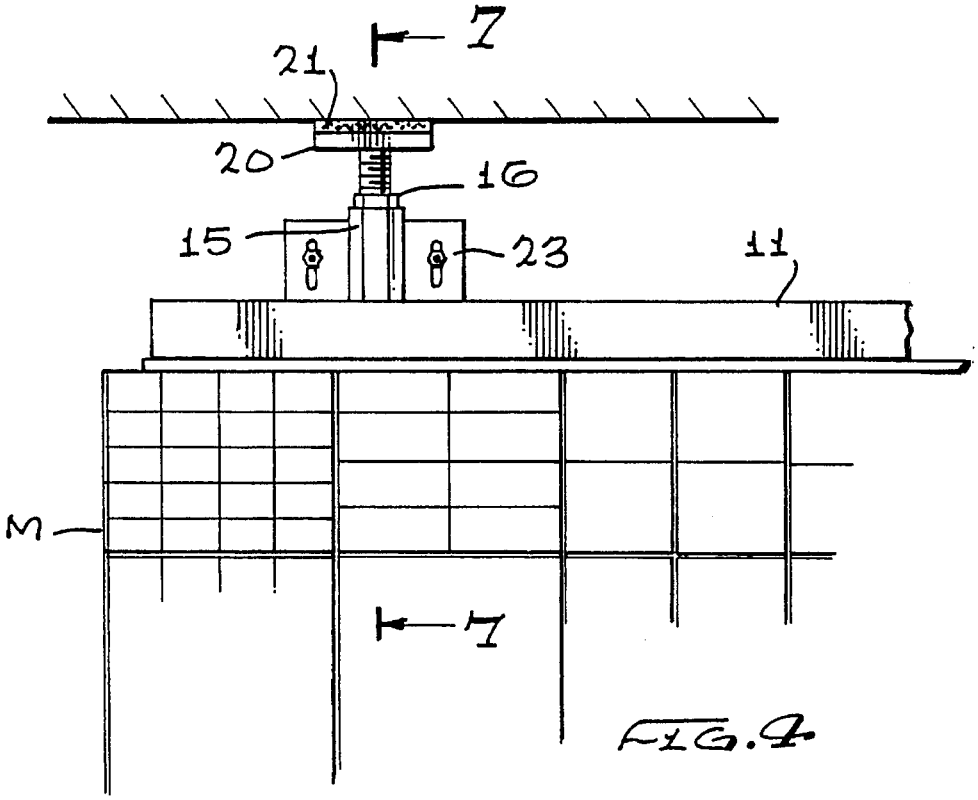
FIG. 4 is a fragmentary front elevational view of the assembly of FIGS. 2 and 3.

Now referring to FIGS. 2–4, a module anchoring system, generally designated 10 may be seen, including a compression beam 11 which preferably is a square or rectangular tube of 1018 steel having an elastomer pad 12 on the under side of the tube and resting on the top of all the modules M.

At the top side of beam 11 is a captured nut 13 which is welded to the top surface 14 of the beam 11. The nut 13 is internally threaded to receive a threaded rod 15 which extends upward and is welded to a ceiling plate 20. A lock nut 16 engages threaded rod 15. The threaded rod 15 is cut to be approximately 1 inch shorter than the distance between the top surface 14 of the beam 11 and the underside of the ceiling plate 20. This distance allows for a tightening of the rod 15 by turning plate 20 and slightly compressing an elastomer pad 21 located on top of the plate 20 in the process. Tightening and locking screw 15 results in the application of a compressive force on the beam 14 and the top of the module array M. The beam 11 is located approximately at the middle of the depth (front to rear) of the module array M as indicated by the equal distance d and is so located by a rear bar 22 and wall plate 23 of FIG. 2. The length of the rear bar 22 is approximately one half of the depth of the modules M, e.g., 13 inches less one half the dimension A of the beam 11. The rear end of the bar 22 is secured, as by welding to the wall plate 23 which has a number of openings OP therein to receive seismic fasteners such as hardened expansion bolts which are placed in the adjacent wall W in accordance with well known seismic protection practice.

In certain situations, the modules M are not of the same or similar height and the ceiling to floor distance is not constant. Employing this invention, such variations are easily accommodated. The solution is shown in FIG. 5. In this embodiment, the compression beam 11 is used, however, the difference in height of the first module stack M1 and the second stack M2 is compensated for by the addition of a welded spacer bar 43 to the underside of beam 11. Since the beam 11 is a standard 2½ inches by 2½ inches hollow square tube, it is ideal for the addition of a rectangular 2½ inches tube 43 of the appropriate height. Such tubes come in increments of ½ inches so that the height of one section can be adjusted in ½ inches increments ready to receive the resilient spacer or pad 12. If more precise positioning is needed, an additional plate may be welded to the underside of the spacer bar 43. This will allow adjustments to within 1/16 inches, if necessary.

Note, in FIG. 5 that the threaded rods 15 are each of different lengths to accommodate the difference in heights of the ceiling from a lower ceiling height at C1 to a higher height at C2.

Figure 6:
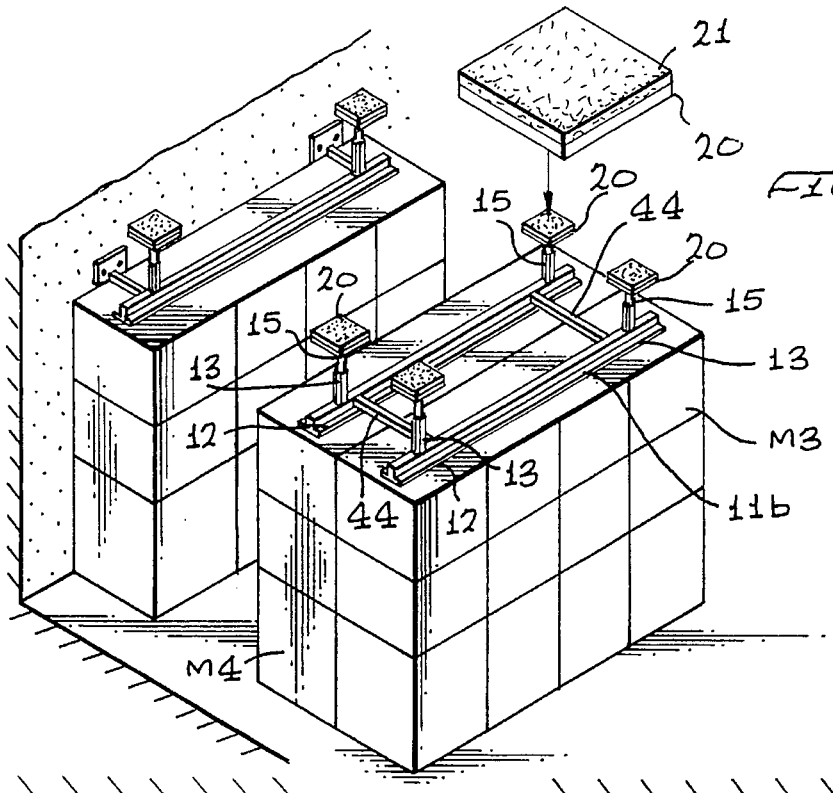
FIG. 6 is a perspective view of an alternate form of this invention designed for freestanding modules with an enlargement of one component.

Another variation of this invention is illustrated in FIG. 6. In that embodiment, a pair of freestanding stacks of modules M3 and M4 are located back to back in a larger safe deposit vault. In this case, a single seismic assembly employing a pair of compression beams 11*a* and 11*b* are used. Instead of rear bars and wall plates, a pair of cross bars 44 are welded between the parallel beams 11*a* and 11*b*. Four threaded rods 15 each engage a respective captured nut 13 and resilient pads 12 are positioned beneath the beams 11*a* and 11*b*. Ceiling plates 20 with their resilient pads 21 are each secured to the ceiling, unshown in FIG. 6, by appropriate seismic fasteners similar to the case for the single stack of FIG. 2. For long rows of modules, the lengths of beams 11*a* and 11*b* are merely extended and one captured nut 13, rod 15 and ceiling plate 20–21 assembly is added for each 10 feet of length of the row.

Figure 8:
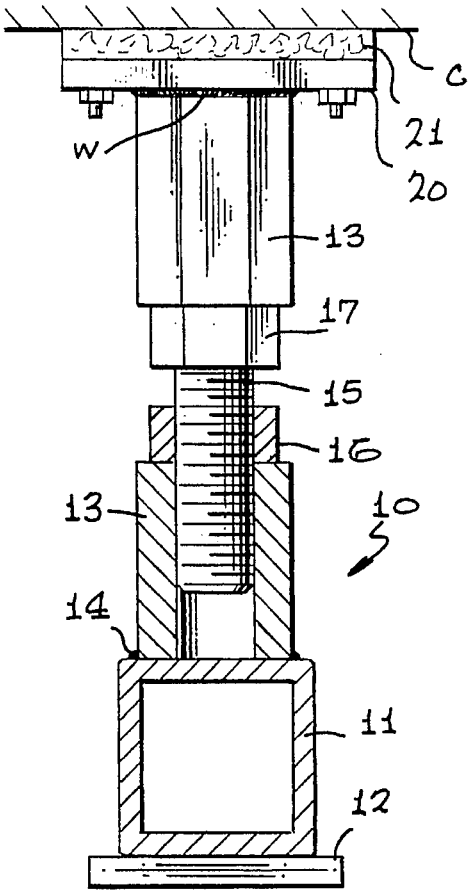
FIG. 8 is an end elevational view, partly in section of an alternate form of vertical support of this invention.
Figure 7:
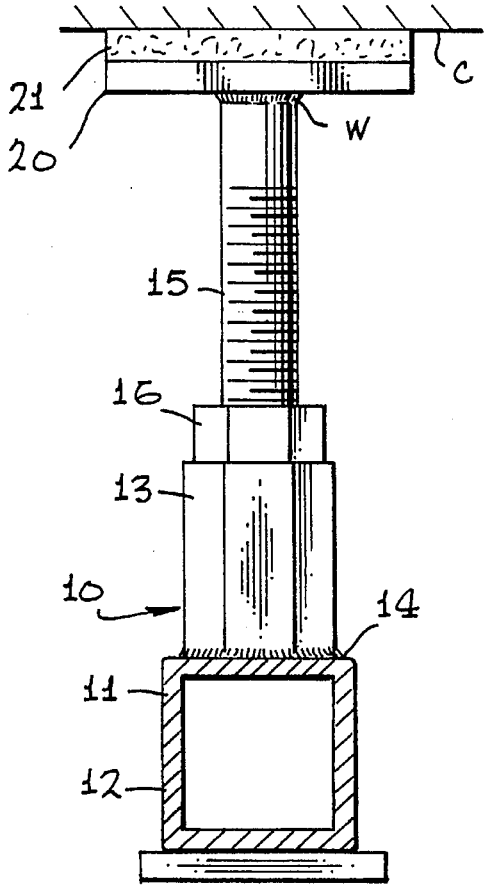
FIG. 7 is a vertical sectional view of this invention taken along line 7—7 of FIG. 4.

We have found that either of two forms of ceiling mounting arrangements may be used in this invention and they are illustrated in FIGS. 7 and 8.

In FIG. 7, the beam 11 may be seen resting on resilient pad 12 which may be a ⅜ inch thick elastomer having a 60 shore to accommodate any slight variations in the tops of the modules M. captured nut 13 is preferably a 3 inch length of 2 inch hexagonal bar stock which is internally tapped for a 1 inch rod with number 8 NC threads. A similarly threaded jam or lock nut 16 is also threaded on rod 15 and is used to lock the vertical assembly when the upper end of the threaded rod 15 and the ceiling plate 20 are unscrewed to engage the ceiling C through the top elastomer pad 21. The rod 15 is welded to the ceiling plate at welds W. This embodiment will allow a minimum height difference between the top of the module M and the ceiling to be 7½ inches and allows for an adjustment of approximately 1 inch.

The embodiment of FIG. 8 is identical with that of FIG. 7 except for the presence of a second captured nut 13 which is welded to the ceiling plate 20 and a second jam or lock nut 17 which engages the second captured nut 13 at the ceiling plate 20. The embodiment of FIG. 8 has a minimum length of 9⅞ inches and has an adjustment range of 1½ inches.

The foregoing embodiments illustrate the best mode with which we are familiar for carrying out this invention. The embodiments are, however, illustrative only and not to be considered as limiting. Rather, this invention is defined by the following claims including the protection afforded by the Doctrine of Equivalents.

What is claimed is:

1. A seismic restraint system in combination with safe deposit boxes in a safe deposit vault having seismic resistant walls, floor and ceiling comprising:

a compression beam having a length substantially the length of a stack of safe deposit boxes;

said compression beam having a lower surface for the application of bearing pressure upon the stack of safe deposit boxes;

a ceiling plate for the application of bearing pressure from the ceiling of the vault to the stack of safe deposit boxes through said compression beam; and adjustable extension means for engaging said compression beam and said ceiling plate to transmit compressive load therethrough after adjustment to accommodate the difference in space between said ceiling plate and said compression beam.

2. A combination in accordance with claim 1 wherein said adjustable extension means comprises a threaded rod and a nut for changing the overall length thereof to apply compressive loading on said compression beam.

3. A combination in accordance with claim 2 wherein said threaded rod is secured to said ceiling plate and said nut is secured to said compression beam and adjustment is obtained by threading said rod and said ceiling plate on said nut.

4. A combination in accordance with claim 1 for safe deposit boxes located near one of said vault walls including laterally extending restraint means secured to said compression beam having a length corresponding to the distance between said compression beam and said vault wall and a wall plate secured to said laterally extending restraint means.

5. A combination in accordance with claim 4 including means for securing said wall plate to said vault wall.

6. A combination in accordance with claim 4 wherein said laterally extending restraint means has a length in the order of one half the depth of the safe deposit box stack.

7. A combination in accordance with claim 1 including elastomeric means positioned between the bottom of said compression beam and the top of said stack of safe deposit boxes.

8. A combination in accordance with claim 1 wherein said compression beam comprises a rectangular tube with one side adapted to engage said stack of safe deposit boxes and the opposite side engaging said adjustable extension means.

9. A seismic restraint system in combination with freestanding stacks of safe deposit boxes in a safe deposit vault having walls, a floor and a ceiling comprising:

a first compression beam having a length substantially the length of a freestanding stack of safe deposit boxes:

a second compression beam extending generally parallel to said first compression beam;

said compression beams having lower surfaces adapted to bear upon said stacks of safe deposit boxes;

spacers secured to said first and second compression beams to provide a rigid compression assembly;

at least one ceiling plate adapted to transmit bearing pressure from the ceiling of the vault to said stacks of safe deposit boxes through said compression beams; and respective adjustable extension means for engaging said compression beams and said ceiling plate to transmit compressive loads therethrough after adjustment to accommodate the difference in space between said ceiling plate and said compression beams.

10. A combination in accordance with claim 9 wherein said compression beams and spacers are each at least two in number.

11. A combination in accordance with claim 9 wherein said compression beams and spacers define a generally rectangular shape.

12. A combination in accordance with claim 9 wherein said spacers comprise cross bars secured to said compression beams at longitudinally spaced locations.

* * * * *